United States Patent [19]

Chevalier et al.

[11] Patent Number: 4,806,115

[45] Date of Patent: Feb. 21, 1989

[54] ASSEMBLY PROVIDING AN ELECTRICAL CONNECTION THROUGH A PIPE FORMED OF SEVERAL ELEMENTS

[75] Inventors: Andre Chevalier, Pantin; Pierre Morin, Levallois Perret; Michel Chardin, Paris, all of France

[73] Assignee: Institut Francais du Petrole, Rueil-Malmaison, France

[21] Appl. No.: 129,769

[22] Filed: Dec. 7, 1987

[30] Foreign Application Priority Data

Dec. 5, 1986 [FR] France ..... 86 17174

[51] Int. Cl.[4] ..... H01R 4/60

[52] U.S. Cl. ..... 439/194

[58] Field of Search ..... 439/190–195, 439/271

[56] References Cited

U.S. PATENT DOCUMENTS 3,170,137 2/1965 Brandt ..... 439/194

4,220,381 9/1980 van der Graaf ..... 439/194

4,557,538 12/1985 Chevalier ..... 439/194

*Primary Examiner*—Joseph H. McGlynn

*Attorney, Agent, or Firm*—Antonelli, Terry & Wands

[57] ABSTRACT

The invention relates to an assembly for providing at least one electric connection between the elements of a pipe each including an electric line, which assembly includes for each pipe element:

a conductor placed inside the element, a first connector and second connectors fixed to each of the ends of the conductor and cooperating electrically with said conductor, a first double connector cooperating electrically by a first end with the first connector, a second double connector cooperating electrically by a first end with the second connector, said first and second double connectors cooperating electrically with respectively the second and first double connectors of the adjacent pipe elements, and means for positioning and fixing the connectors.

13 Claims, 10 Drawing Sheets

FIG
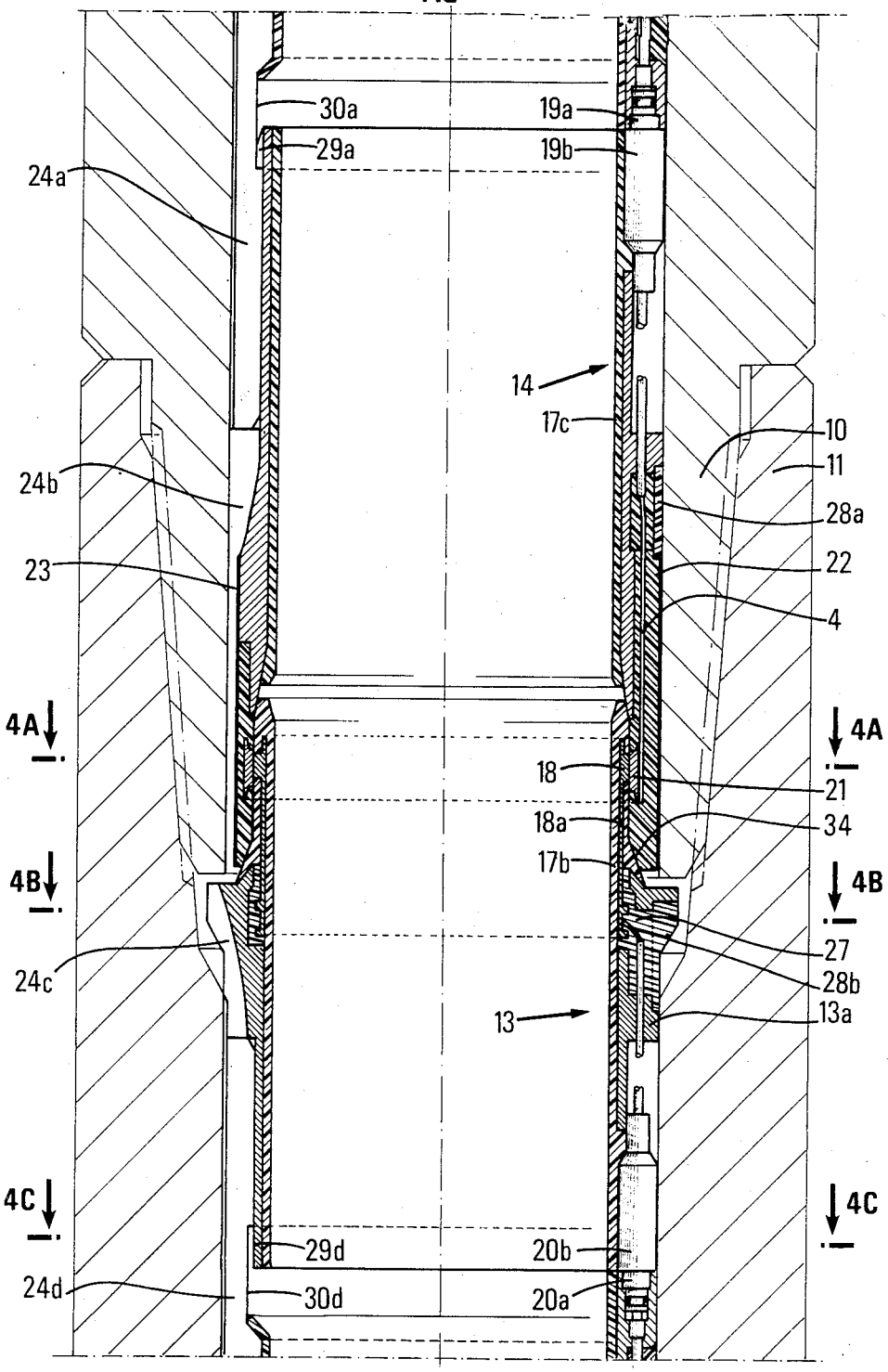

ASSEMBLY PROVIDING AN ELECTRICAL CONNECTION THROUGH A PIPE FORMED OF SEVERAL ELEMENTS

BACKGROUND OF THE INVENTION

1. Field of the Invention

The present invention relates to an assembly for providing at least one electric connection between two points through a pipe, such an electric connection possibly serving, among other things, for supplying certain apparatus from an electric source, or for transmitting coded informations in the form of electric signals.

This assembly may be used for example in a drill-pipe string. It may in this case transmit certain electrically coded information from the bottom of the well, such for example, as the direction of the well, the mechanical stresses exerted on certain parts, the temperature, the pressure, etc. . .

2. Description of the Prior Art

Approaches attempting to attenuate certain drawbacks of the devices of the prior art, such as those illustrated by U.S. Pat. Nos. 2,096,359, 3,696,332 and 3,879,097, have been proposed by the applicant in French patent No. 2 530 876. However in use, these solutions have caused new drawbacks to appear, such as the need of machining pipe elements, the mechanical fragility of pipe element end connectors, the precarious electric insulation of the terminal or intermediate contacts, the wear of non interchangeable parts, the difficulties in dismantling, the difficulties in fitting, the manufacturing costs.

These drawbacks are overcome, or at least very substantially attenuated, by using the device of the present invention.

SUMMARY OF THE INVENTION

This device includes an assembly making it possible to provide at least one electric connection through a pipe formed of elements fixed together, in which each element has a first and a second end, adapted for cooperating mechanically with the complementary ends of the adjacent elements. This assembly is particularly characterized in that it includes in combination, per pipe element:

a conductor placed inside the element, a first connector fixed to one end of the conductor which is held in position in the first end of the pipe element and which cooperates electrically with the conductor, a second connector fixed to the other end of the conductor which is held in position in the second end of the pipe element and which cooperates electrically with said conductor, a first double connector having a first end which includes at least one contact and a second end having at least one annular contact connected electrically to the preceding one, the first end of the first double connector cooperating electrically with the first connector, the second end of the first double connector cooperating electrically with a second end of the second double connector of an adjacent pipe element, said second double connector having a first end with at least one contact, and a second end with at least one annular contact connected electrically to the preceding one, the first end of the second double connector cooperating electrically with a second connector, and means for positioning and fixing the connectors.

The first and/or the second connector may have a radially deformable ring and means for deforming said ring making it possible to anchor the ring of said connector with the ends of the pipe element.

The deformation means may include a pin having, over a certain length, a conical shape cooperating with a bore formed in the thickness of said ring, the ring being split throughout its thickness over a part at least of its length.

A double connector associated with another connector may have means for centering and retention against translation with respect to the connection. Centering and retention means may include a bore having a groove cooperating with a socket having at least one resilient claw.

The double connector and the associated connector may include means for orientating one with respect to the other, such as a key carried by the double connector, the key cooperating with a groove situated in said connector.

Between the connector and the associated double connector, the electric connection may include an electric contactor, such as a monocontactor, having two complementary elements adapted for forming an electric connection, each of the elements being disposed at the periphery of the connector and of the associated double connector, the axes of the elements being merging and parallel to the axis of the assembly, two elements of the contact cooperating electrically during fixing of the associated double connector.

The second end of the first double connector may include an external annular contact and the second end of the second double connector may include an inner annular contact, each of the two contacts carried by each of the ends being adapted to cooperate electrically with the contacts carried by the complementary ends of the adjacent elements.

One or other of the second ends of the double connectors may include a scraper for wiping and sealing the electric contact between the two ends.

One at least of the second ends of one of the double connectors may be made from an elastomer having a reinforcement element.

One at least of the ends of said pipe may include a cavity internal to said pipe and external to the second end of a double connector, and may include a hydraulic connection connecting said cavity to the inside of the double connector, this hydraulic connection being adapted to provide the hydraulic balance of the connection between two adjacent pipe elements.

The two contacting surfaces defined by the connection of the second end of the first double connector with the second end of the second double connector of the adjacent pipe element may be formed from wear resistant materials.

The conductor may be held in position inside the pipe element by a support.

The ends of the support may be fixed to the first and second connectors.

The present invention relates also to a method for setting in a determined position a piece comprising a conductor, such as an electrical conductor, on a portion of the inner surface of a pipe. This method allows to set said assembly.

BRIEF DESCRIPTION OF THE DRAWINGS

Other aims and advantages of the present invention will be clear from reading the description of one example more particularly applied to drilling strings, given by way of illustrative but not limitative example with reference to the accompanying drawings in which:

FIGS. 2*a* to 2*c* show two elements of a pipe equipped with the connection assembly and connected together.

DESCRIPTION OF THE PREFERRED EMBODIMENTS

In order to facilitate the understanding of the simplified example which follows, the type of the different connectors has been fixed. Thus, the first connector is identical to the second connector, the first double connector has a first male end cooperating with the first connector and a second male end, the second double connector has a first male end cooperating with a second connector and a second female end adapted to cooperate with the second male end of the first double connector of an adjacent pipe element.

The first double connector will be called male double connector and the second double connector will be called female double connector.

Figure 1:
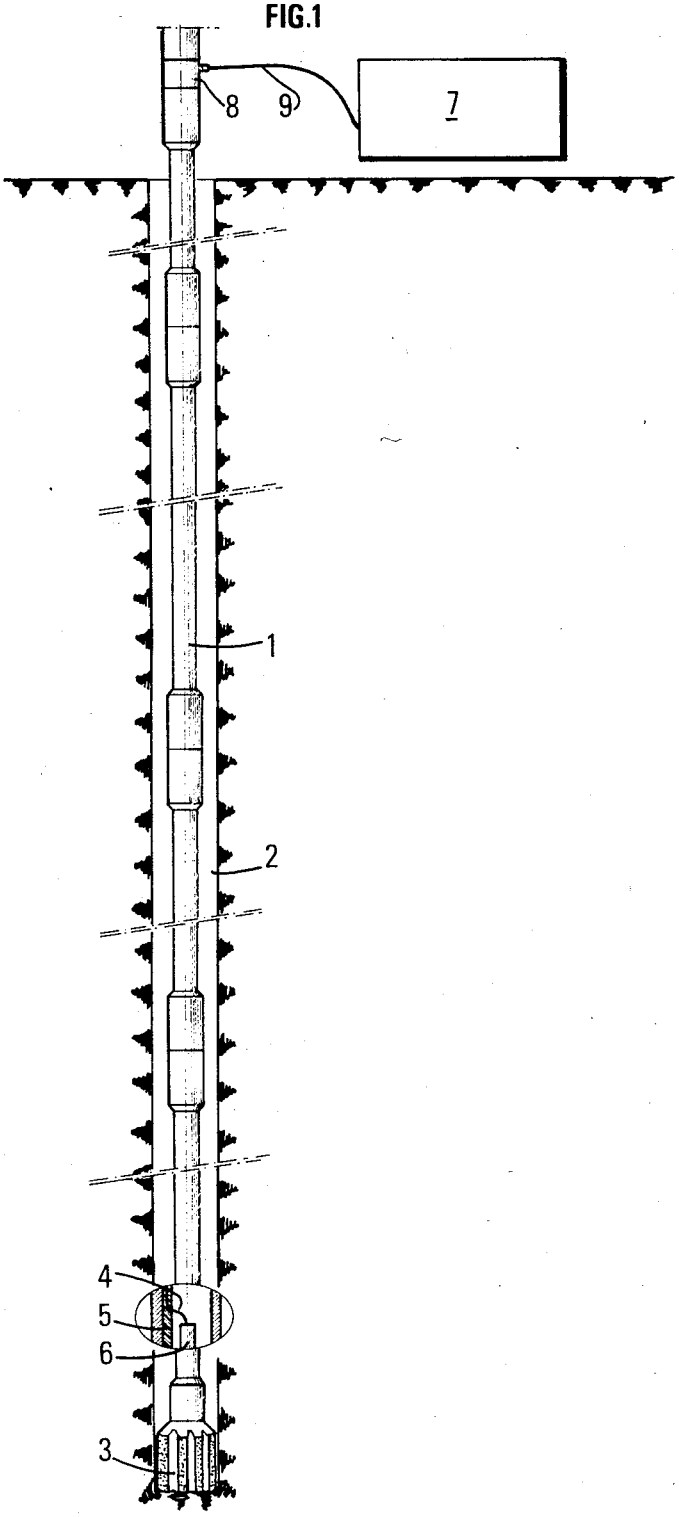
FIG. 1 shows a drilling well.

FIG. 1 shows an embodiment of the invention applied to a drill-pipe string 1. The well is designated by the reference 2. Reference 3 designates a drilling tool which may be replaced by any tool, or by a measuring probe. The junction between the different elements forming the drill pipe string has not been shown.

Figure 2A:
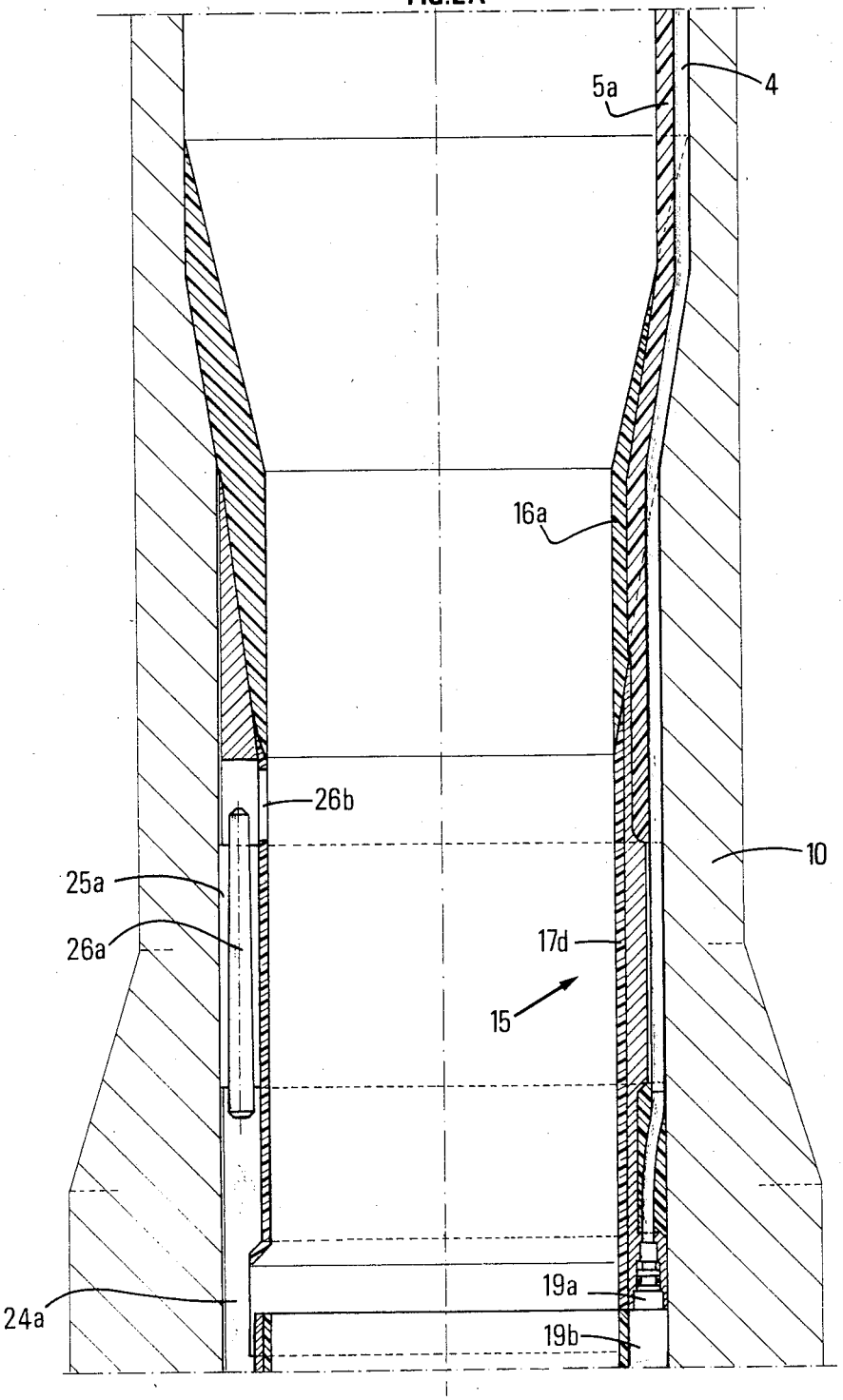
Figure 2C:
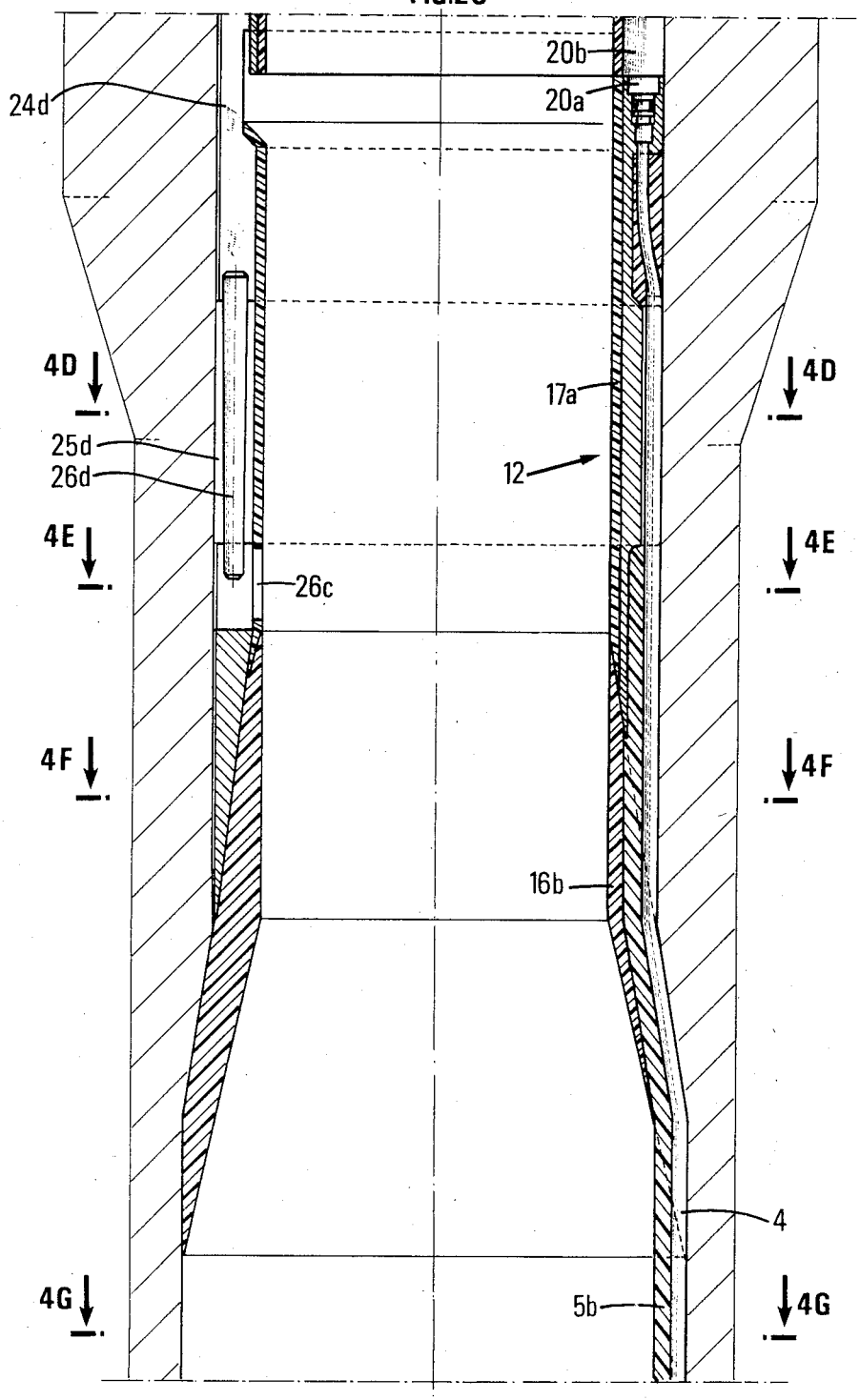

One example of this junction is shown in FIG. 2.

It is of course possible in some cases to use the drill string, or even the earth or mud, as electricity conducting medium. This makes it possible to form an electric circuit using only a single electric conductor insulated from the support. This is moreover the case of a single conductor which will be described in detail hereafter, but the invention is also applicable to the case of several conductors.

In the case of FIG. 1, the electric conductor 4 is buried in the mass of a support 5 internal to the pipe. The electric conductor 4 may be equipped with its own insulation, particularly if support 5 is not sufficiently electrically insulating.

In the case illustrated in FIG. 1, conductor 4 connects an apparatus 6 to a surface installation 7, these two assemblies cooperating electrically together. It is possible to use the assembly providing an electric connection in accordance with the invention, when the drill pipe string rotates. For this, it is necessary to have at least one rotary contact. This may be formed, for example, by a ring 8 cooperating electrically with a contact 9. Since such devices are known in the prior art, they will not be described in detail here.

FIG. 2 shows the junction between two adjacent elements of a pipe, each of these elements being equipped with different parts providing the electric connection. In this FIG., the two elements of the pipe are screwed together. The invention is applicable to any type of connection by screwing or otherwise, as long as the operation for connecting different elements together uses at least an axial movement.

The male side 10 of a pipe element is screwed to the female side 11 of the adjacent pipe element. References 5*a* and 5*b* designate respectively the support containing the electric conductor on the male side of a pipe element and on the female side of the adjacent element.

The connection assembly includes, in addition to the support, a first connector 12, a male double connector 13, a female double connector 14, a second connector 15, as well as fixing means.

The mechanical connection between the first connector 12 and support 5*b* or between the second connector 15 and support 5*a* may be provided, depending on the nature of the materials used such as elastomers, heat hardenable or thermoplastic materials, by vulcanization, cross linking, welding, molding or any other means, respectively 16*a* and 16*b*, after the ends of the conducting wire 4 housed in support 5*a* and 5*b* has been electrically connected respectively with the conductors of connectors 12 and 15.

The mechanical connections 16*a* and 16*b* may be provided otherwise than by immobilizing the end of the support in the connector without having recourse to the material and to the conical shape of connections 16*b*.

An adjusted notch may for example be formed at the periphery of the connector for fitting the support therein.

The conical shape making possible progressive connection of the sections may then be obtained by machining in the connector.

The inner surface of each of the single or double connectors 12, 13, 14, 15 may be covered with a layer protecting against damage such as: corrosion, erosion, (abrasion, cavitation...), respectively 17*a*, 17*b*, 17*c*, 17*d*. This protective layer may be formed from the same material as that used for the mechanical connection between connectors 12 and 15 and their support. It may be advantageously formed from an elastomer.

The male double connection 13 which includes an external annular contact 18 connected to conductor 4 by a resilient conducting socket 18*a* will be covered, at least over the electric parts of the socket which have to be insulated, by a resilient and insulating material such as an elastomer. The protective layer of this connection which must be resilient, at least at the level of the resilient socket, may be advantageously formed from the same material as that use for the electric insulation of the socket.

The electric connections of two adjacent pipe elements between the first or the second connector and their associated double connector is provided by means of a pair of electric plugs having their axis parallel to that of the elements of the pipe.

This pair of plugs, adapted to withstand liquids under high pressures, such as those met with in drilling wells, is for example a pair of Duo-seel plugs, which is a trademark registered by the firm Kemlon.

The male plugs 19*a* and 20 are respectively screwed on the connectors 12 and 15, whereas the associated female plugs 19*b* and 20*b* are fixed, by fitting together or any other appropriate means to the associated connector respectively 13 and 14.

The male plugs could without disadvantage be reversed with the female plugs.

The male plugs 19*a* and 20 are connected electrically respectively to the electric conductors of each of the connected pipe elements.

Insulation of the electrically conducting portions (conductors, connections between the male plugs 19 and 20*a* of these conductors, etc) is provided by the fact that they are embedded in an insulating material, such as a resin or a stabilizable material.

The male plugs 19*a* and 20*a* may not be connected directly to the electric conductors. In fact, in certain cases of intensive use of the equipment when the risks of damaging the male plugs 19*a* and/or 20*a* are increased, the electric conductors may end in additional female plugs and the male plugs 11*a* and 20*a* be connected to the additional plugs of the same type, as these latter.

The male plugs 11*a* and 20*a* as well as the additional male plugs cooperate electrically together and are placed in pairs at each of the ends of a sealed tube. The tube being removable, it may be changed if it is defective.

The female plug of the male double connector is connected by the conducting socket 18*a* to the external annular contact 18 and a female plug of the female double connector is connected to the inner annular contactor 21 by a connecting conductor. These two annular contactors 18 and 21 cooperate together so as to provide the electric connection between two adjacent pipe elements.

The inner annular contactor 21 and a portion of the conductor providing the electric connection between said contactor and the female plug of said female double connector 14, are rigidly fixed to said double connector by means of an epoxy resin support 22 in which said contactor 21 and said portion of the connecting conductor element are embedded.

The resin is adapted so as to withstand high pressures and to provide electric insulation of the portions of the socket and of the connecting conductor which might be bared.

Support 22 is made rigid by a collar 23 adapted to withstand the sudden differential pressure variations between the inside of the pipe and the outside of the female double connector. In fact, the pipes, particularly those used in drilling or subterranean effluent production, are often subjected to mechanical or hydraulic shock waves, such as hammering, which may generated fatal damage, particularly at the level of the connection together of the two double connectors.

To overcome these drawbacks and make it possible to balance the connected parts at the time of their connection (an overpressure on the outside of the second ends of the double connectors could cause damage of their ends). The connection between the male double connection and the female double connection is balanced on each side of its thickness by the lateral channel 24*a*, 24*b*, 24*c*, 24*d* whose dimensions are adapted in particular to reduce the effects of shock waves and to prevent clogging.

This lateral channel opens into the inner space at two points at the levels of the joints between the connectors 12 and 15 and the double connectors respectively 13 and 14. The channel which passes through an annular space (zone between the pipe elements 10 and 11 and the second ends of the double connectors 13 and 14) includes grooves 24*a* and 24*d* formed in the connectors 12 and 15 and grooves 24*b* and 24*c* formed in the double connectors 13 and 14.

The two grooves 24*b* and 24*c* open into the annular space surrounding the second connector ends of two double connectors.

These grooves 24*a* and 24*d* of the connectors open into grooves 24*b* and 24*c* formed respectively in the female double connector and the male double connector.

These grooves 24*a* and 24*d* are the continuations of the expansion slits 25*a* and 25*d* of connectors 12 and 15.

The hydraulic balance of the second connected ends could be achieved by using, instead of a lateral channel opening upstream and downstream of the two second ends, a blind channel whose closed end on the one hand reaches said annular space and on the other opens inside the pipe. However, the lateral channel is the preferred balancing method for applications to drilling.

The first connector like the second connectors are secured to the ends of the pipe elements in which these connectors are housed by expansion of the connectors, each having a tapered pin 26*a*, 26*d* cooperating with a bore placed in a slit 25*a*, 25*d*.

Correctly positioned inside the pipe elements, the connectors are then fixed by expansion of their bore by means of tapered pins driven in from the end of the pipe.

These connectors may be removed by releasing the pins 26*a* and 26*d*, for example using a hooked tool penetrating into the inner part 26*b* and 26*c* of an expansion slit. Positioning of the connectors is easy and requires no particular machining. Their ready removal does not damage the pipe elements.

Figure 3:
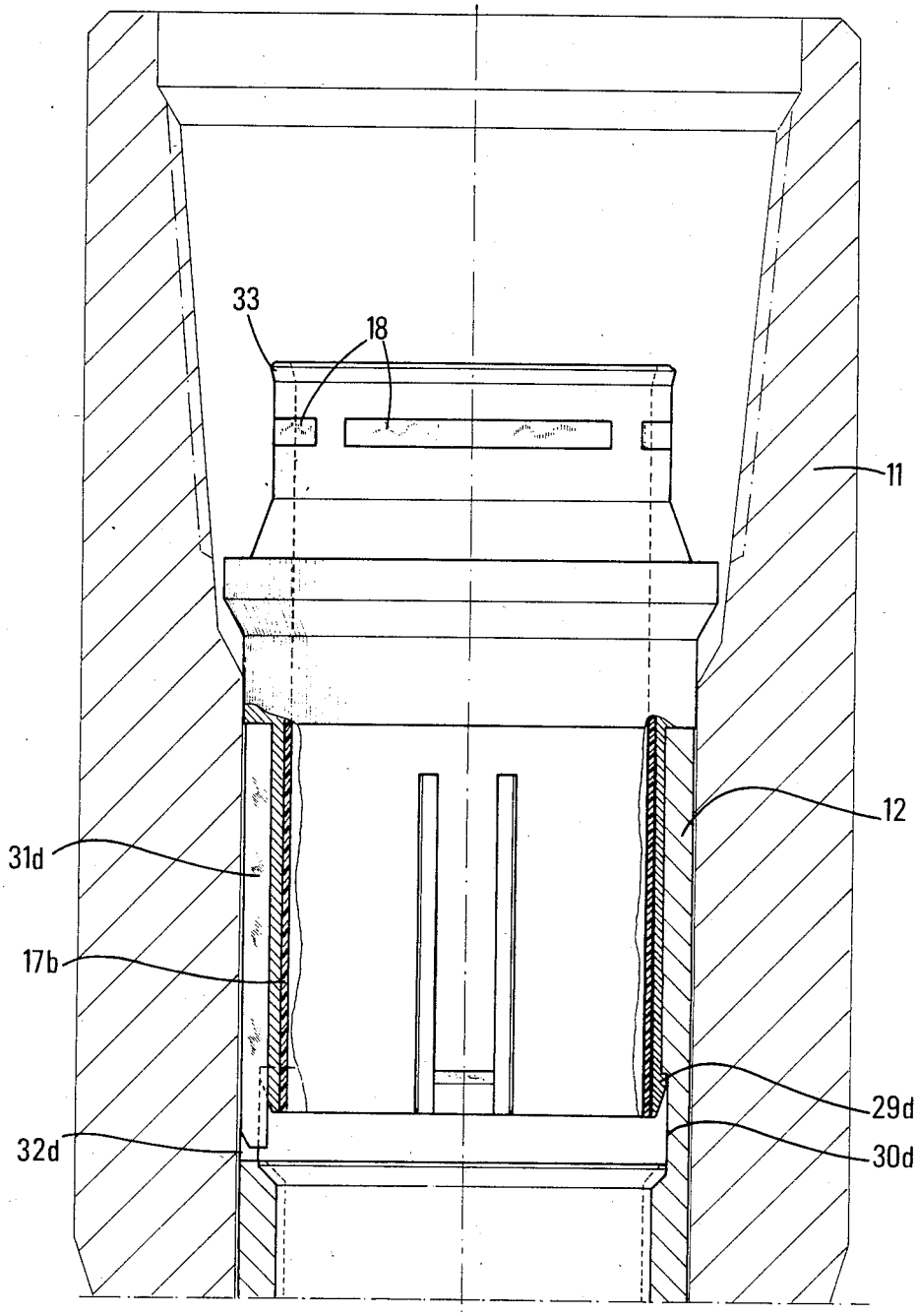
FIG. 3 illustrates a section of the first removable double connector.

The double male connector and the double female connector are positioned respectively for rotation on the first connector and the second connector each by means of a key 31*d* (FIG. 3) carried by the two double connectors and cooperating with an emergent groove 32*d* placed in the associated connectors. This rotational positioning makes plugging and prevents the deformation in use of the pairs of plugs 19*a*, 19*b* and 20*a*, 20*b*.

The two double connectors are immobilized with respect to the first and second connectors by means of a socket 29*a*, 29*d* having at least one resilient claw cooperating with a groove 30*a*, 30*d* placed inside the associated connectors.

Removal of this or these claws for removing the double connector , for example for replacing it when it is damaged (wear, . . . ), may be possible by means of an adapted tool.

Support 22 of the inner annular contactor, or support 27 of the conducting socket 18*a* respectively on the double female and male connectors, which are made from a cross linkable rigid material, are molded by injection through orifices 28*a* and 28*b* by means of a mold.

The second end of the double male connector has an annular resilient lip 33 (FIG. 3) for wiping the contacts 21 and ensuring sealing of the compartment containing the contacts 18 and 21.

During connection, the chamfer 34 wipes the contact 18 by deformation of the second (male) end of the double male connector.

The resilience of the conducting socket 18*a*, as well as the elastomer coating thereof in the region of the outer annular contactor 18 on the part cooperating with the second end of the female connector, provides structuring of the two second ends of the two double connectors and make possible a sealed connection electrically insulated with respect to the outside of the conductor.

Figure 4A:
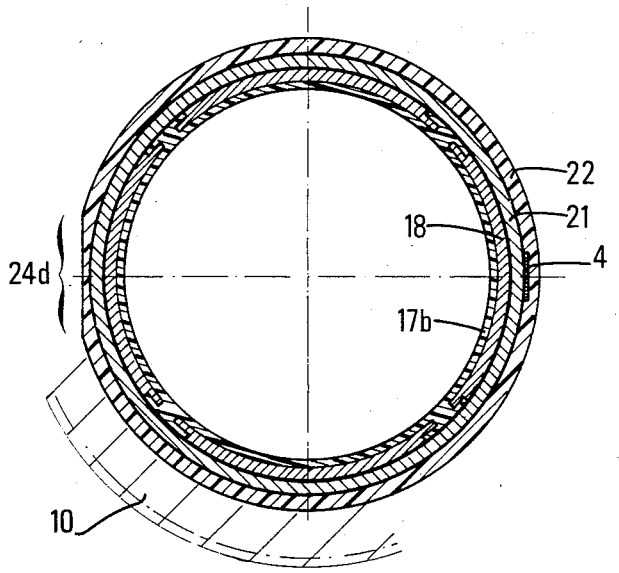
FIGS. 4*a* to 4*g* illustrate different sections of the assembly referenced in FIG. 2.

FIG. 4A illustrates a section of the double connectors in line with the contacts 18 and 21 of the double-connectors. The conducting socket 18*a* is divided, over at least the contact length between the two double connectors, into four sectors between which an electrically insulating elastomer material is placed. These resilient sectors are deformed at the time of connection and cooperate with the annular contact 21 of the double female connector so as to cause a certain pressure on the contacts 18 and 21 of each of the second ends of the two double connectors.

Adaptation of the rigidity, of the materials and of the shapes of the female end of the double female connector and of the second end of the double male connector makes it possible to obtain an electric connection and which its insulation cannot be damaged when the pipe is subjected to the hydraulic pressure.

Figure 4B:
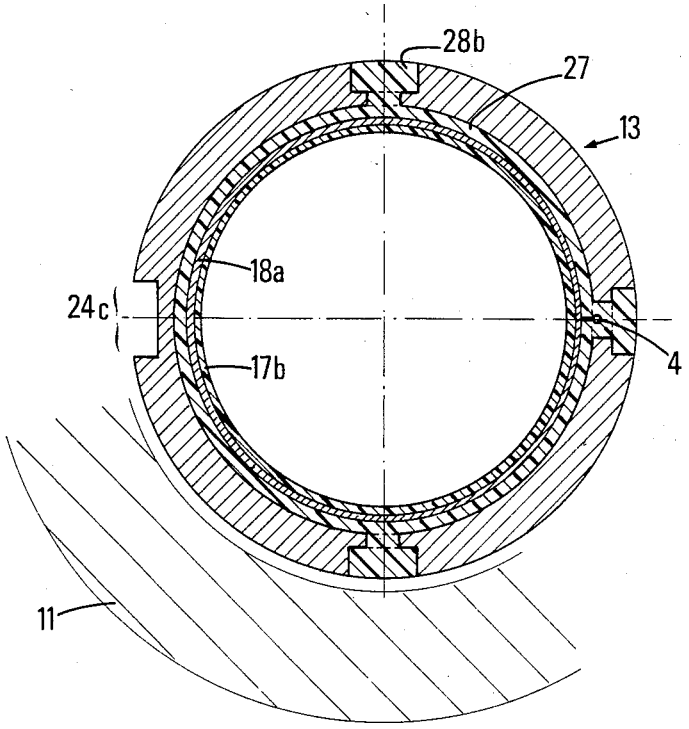

FIG. 4B shows a section of the double male connector in line with the anchorage of the conducting socket in the rigid body 13*a* of the double male connector. Body 13*a* has the groove 24*c* for balancing the pressures on each side of the members making the connection possible. The end opposite the contactor 18 of the conducting socket 18*a* is fixed to body 13*a* by means of an insulating thermosetting material 27, such as a dielectric resin, which may be injected into the body through the injection orifices 28*b*. The inside of socket 18*a* is coated with an insulating and abrasion resistant coating 17*b* made for example from an elastomer material.

Figure 4C:
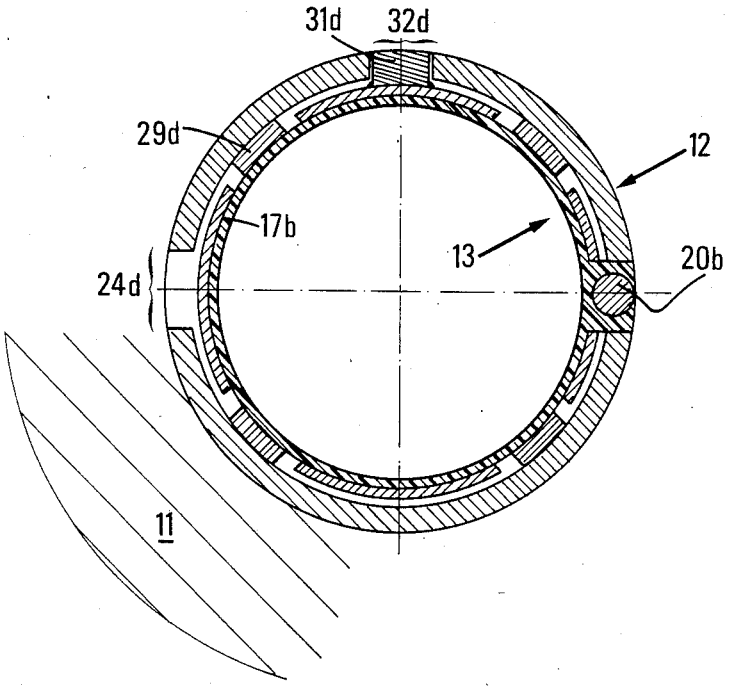

FIG. 4C shows a section of the first connector cooperating with the first end of the double male connector at the level of the four claws 29*d* and the translational immobilizing groove 30*d*. The inner antiabrasion elastomer coating 17*b* of the double male connector also provides immobilization of the female plug 20*b*, which plug cooperates with the male plug 20*a* (FIG. 2) carried by the first connector. The first connector 12 is provided with a groove 32*d* cooperating with the key 31*d* for securing the first connector against rotation with respect to the first double connector. These immobilization means 29*d*, 30*d*, 31*d*, 32*d* are identical to those used for immobilizing the second connector with the second double connector. The first connector includes a groove 24*d* forming a part of the hydraulic balancing channel of the connection.

Figure 4D:
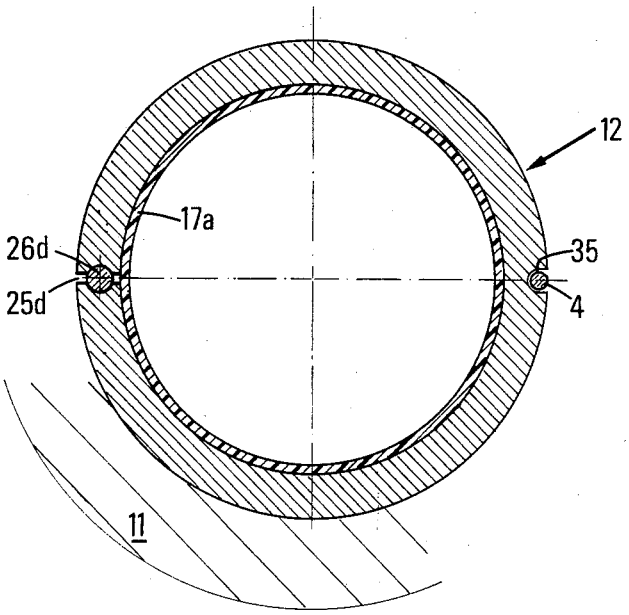

FIG. 4D illustrates a section of the first connector at the level of the tapered expansion pin.

Pin 26*d* cooperates with a bore for causing widening of slit 25*d* and therefore jamming of the connector in the pipe elements surrounding the connector. The conductor is insulated and placed in groove 35 formed in the first connector.

Figure 4E:
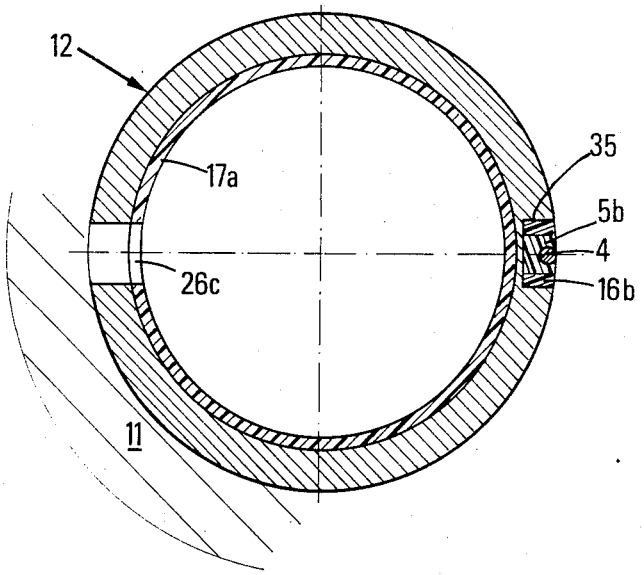

FIG. 4E is a section of the first connector at the end of the conductor support.

Between the connectors placed at each of the ends of the same pipe element, the electric conductor 4 is placed in a support 5*b* or 5*a*. This support is adapted for adhering to the inner surface of the pipe element.

The ends of this support are squared to be placed in the widened groove 35 of the first and second connectors of the pipe element so as not to produce any discontinuity of support 5*b* weakening the conductor 4.

The interstitial space defined by the squared support and the widened groove 35 is filled with elastomer so as to provide immobilization of the support in the groove. This space could also be filled with any suitable material such as a cross linkable material, or could not exist, to the extent that the square support fills the whole of groove 35.

Diametrically opposite groove 35 is placed a tapered pin 26*d* cooperating with a bore for anchoring the first connector.

Figure 4F:
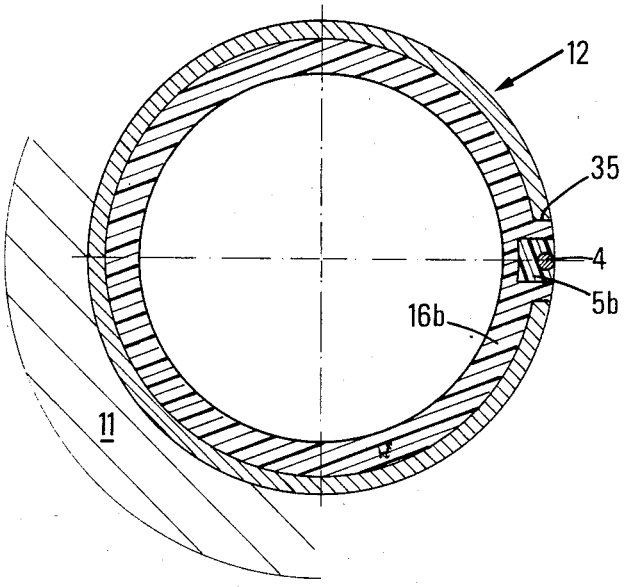

FIG. 4F shows a section of the first connector and of the mechanical connection of the support with said connector at the level of said connection.

Said connection 16*b* is in contact over the whole of its circumference with the connector 12 .and holds the squared support in groove 35 passing through the thickness of the connector at the level of the section FF. The connection 16*b*, like all the mechanical connections of the connectors with support 5, may be formed from an antiabrasion material such as an elastomer. The inner shape of the connection is adapted so as to avoid detachment of the flow which would be caused by the sudden variation of inner section of the pipe between the connectors and the part external to the connectors.

This variation of section is obtained by a low inner conicity of the connection. The conicity of connection 16*a* extends until its inner diameter is equal to its outer diameter or to the inner diameter of the pipe element.

The support 5*b* of conductor 4 passes (FIG. 2) through the mechanical connections 16*b* while clinging thereto.

In the preferred embodiment of the invention illustrated in the accompanying FIGS., support 16*b* has only a reduced width, but this support could cover the whole of the inside of the pipe element while holding conductor 4 in position. Such an arrangement, which has the drawback of reducing the passage section of the pipe, would have the special advantage of protecting the inner surface of the pipe from wear resulting from abrasion or erosion.

Figure 4G:
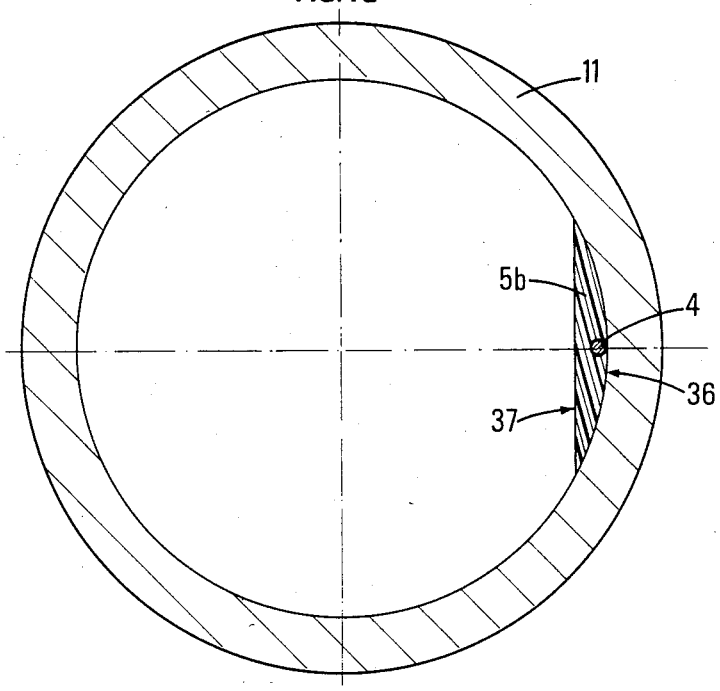

FIG. 4G is a section of the pipe in its ordinary length. Support 5*b*, which contains the electric conductor either embedded or placed in a groove in this support, includes an osculating or convex surface 36 cooperating with the internal surface of the pipe so as to hold the support and the conductor in position in the pipe, and includes a curved or concave surface 37 defining the new contours of the passage section of the pipe element comprising said support.

The convex and concave surfaces are said to be complementary with each other not because they are in contact with each other but because they belong to the same element.

A plane curved surface, such as shown in FIG. 4G, offers the advantage first of having no proeminence whose existence more particularly during transfer of materials rotating inside the pipe would facilitate damage of the support and removal thereof from the pipe and secondly, of not reducing too much the passage section of the pipe.

The section of support 5*b* could also have the shape of a miniscus whose concave face has a smaller or larger radius than that of the convex surface.

Depending on the shape of the conductor (or conductors) which may be of a circular, square, rectangular, flattened, curved section and is formed for example in the mass or in the shape of braid, the support may have numerous shapes which are, on the one hand, adapted for cooperating with a part of the inner facing pipe surface and/or which are on the other hand adapted for structuring the fluid flow, for example by adapting the shapes and materials so as to reduce the pressure losses, and finally possibly adapted to the passage of elements such as tools, instruments or cables.

The material of support 5*b*, which may be insulating material, for example when the conductor is bared, may be a plastic material stabilizable by means of a physical or chemical process, such as melting with cooling, cross linking or vulcanization.

These materials may for example be thermoplastic materials, thermosetting materials or elastomers. These latter have the particular advantage of having good resistance to abrasive wear.

Depending on the process for positioning the support, supports may be used made from a material which is not yet stabilized, partially stabilized or completely stabilized, or having parts which are differently stabilized.

Thus, as will be described hereafter in the preferred method of positioning the parts inside a pipe, the support containing the conductor is made from a sufficiently stabilized material (even completely) so as not to be unfortunately deformed under the action of the expansion means and may be covered over its convex surface with the same material, but untreated so as to allow the support to cling to the part of the pipe element.

Support **5*b*** may also be used, for example in a configuration similar to the one described, for holding in position a hydraulic or pneumatic conductor or any mechanical parts which need to be placed in the vicinity of the inner wall of a hollow body.

Figure 5:
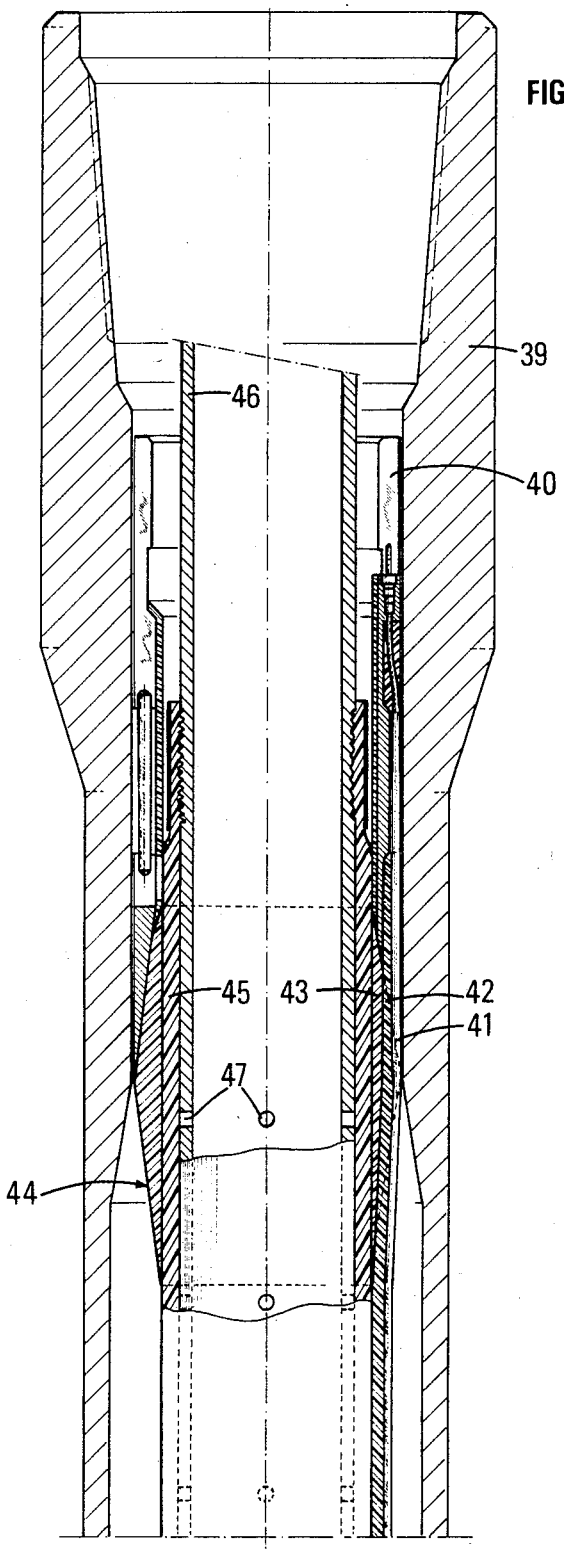
FIG. 5 shows schematically the method for positioning the electric line.

FIG. 5 shows the apparatus for positioning the support 42 of conductor 41 as well as the mechanical connection element 43 between support 42 and connector 40 inside the pipe 39. The apparatus includes a stretchable casing 45 resting in a retracted position on a rigid tube 46 pierced with orifices 47 situated opposite the part of the casing to be expanded. Casing 45 and tube 46 form a closed volume having an opening connected to expansion means including a pressurized fluid generator adapted for inflating the casing so as to be able to position the support on the part of the inner surface of the pipe. The concave surface of the support may be advantageously positioned and held on the outer surface of the casing before this latter is inflated, but it is possible to have first of all placed the support or any other piece in the pipe or any hollow shape, before the casing holds them in position.

The convex surface of the support may be covered with a mastic, with an adhesive or untreated elastomer so as to provide adhesion of the support on the part of the inner surface of the pipe.

A thermoplastic or thermosetting material may also be used adapted for producing the same effects.

To provide adhesion of the piece on the pipe part, any adapted adhesive material may be used and the surface of the pipe may also be treated by any appropriate treatment, such as sand blasting or the formation of a prelayer.

For some drilling pipe elements already coated with a resin, such as "tube-kote coating" which is a trademark filed by the firm AMF Tuboscope, in order to keep this coating, an appropriate adhesive material may be chosen.

In the preferred embodiment, the adhesive material is an untreated elastomer of the same type as that used for the support. Placed on the convex surface of the support, it is vulcanized by the fluid for expanding the casing which in this case is steam, so as to produce adhesion by heating.

The connectors 40 at the ends of the electric connection system comprising a conductor 41 and a support 42, as well as the mechanical connection 43 between each of the collectors 40 and support 42, are disposed on the casing 45 retracted on the rigidification tube 46.

The support and the connection are then coated with adhesive material.

The apparatus thus formed is introduced into pipe 40 in which it slides. The casing is expanded and heated so as to 25, apply the support 42 of the conductor and connection 44 against the inner part of the pipe.

The implementation of the method for setting in a determined position a piece or support **5*b* comprising the conductor 4, 41 on a portion of the inner surface of the pipe 11, 39** contains the following steps:

The curved surface 37 of said piece **5*b*, 42 is placed and held on an external surface of a stretchable casing 45** adapted to be slided in said pipe according to an arrangement allowing to obtain said determined position;

said casing 45 with said piece is introduced into said pipe 11, 39;

said casing 45 is inflated so as to apply said convex surface on said portion; and adhesion of said convex surface 36 is provided on said portion of the pipe.

When the adhesion of said convex surface on said portion should be made by heating, said casing may inflate by means of a fluid, such as steam, the temperature of which is adapted to provide adhesion of the convex surface 36 on said portion of the pipe.

When aid piece comprises at least one connector at one of its ends, the connector may be connected to said conductor before the casing being introduced in the pipe.

At least one connector 12, 15 may be set in one of the ends f the piece, the connector being connected to the connector, before the casing 45 is introduced into the pipe 11.

When the shape of the piece is changed of the convex surface having initially a shape allowing to the piece to get into the pipe, and having after deformation a shape allowing the convex surface to cooperate with the portion of said pipe, during the inflation of said casing, the piece may bend.

The portion of the inner surface of pipe and/or the convex surface of the piece may be coated with an adhesive matter adapted to achieve in operation the holding of the piece on the portion.

Before coating the portion or the convex surface or introducing the piece into the pipe, a surface treatment increasing the adhesion of the piece in the pipe, as a mechanical or chemical treatment, may be realized.

What is claimed is:

1. An assembly making it possible to provide at least one electric connection through a pipe formed of elements fixed together, in which each element has a first and a second end, adapted for cooperating mechanically with the complementary ends of the adjacent elements, this assembly being particularly characterized in that it includes in combination, per pipe element:

a conductor placed inside the element, a first connector fixed to one end of the conductor which is held in position in the first end of the pipe element and which cooperates electrically with the conductor, a second connector fixed to the other end of the conductor which is held in position in the second end of the pipe element and which cooperates electrically with said conductor, a first double connector having a first end which includes at least one contact and a second end having at least one annular contact connected electrically to the preceding one, the first end of the first double connector cooperating electrically with the first connector, the second end of the first double connector cooperating electrically with a second end of the second double connector of an adjacent pipe element, said second double connector having a first end with at least one contact, and a second end with at least one annular contact connected electrically to the preceding one, the first end of the second double connector cooperating electrically with a second connector, and means for positioning and fixing the connectors.

2. The assembly as claimed in claim 1, wherein said first and second connectors have a radially deformable ring and means for deforming said ring for anchoring said ring of said connector with the ends of said pipe element.

3. The assembly as claimed in claim 2, wherein said deformation means include a pin having, over a certain length, a conical shape cooperating with a bore formed in the thickness of said ring, said ring being split throughout its thickness over a part at 1 east of its length.

4. The assembly as claimed in one of claims 1 to 3, wherein a double connector associated with a connector includes means for centering it and retaining it against translation with respect to said connector.

5. The assembly as claimed in claim 4, wherein said centering and retention means include a bore having a groove cooperating with a socket having at least one resilient claw.

6. The assembly as claimed in one of claims 1 to 5, wherein the connector and the associated double connector include means for orientating one with respect to the other, such as a key carried by the double connector, said key cooperating with a groove situated in said connector.

7. The assembly as claimed in one of claims 1 to 6, wherein said electric connection includes between the connector and the associated double connector an electric contactor, such as a monocontactor, having two complementary elements adapted for forming an electric connection, each of said elements being disposed at the periphery of the connector and of the associated double connector, the axes of said elements merging and being parallel to the axis of the assembly, said two elements of said contactor cooperating electrically during fixing of the associated double connector.

8. The assembly as claimed in one of claims 1 to 7, wherein the second end of said first double connector includes an external annular contact and the second end of said second double connector includes an inner annular contact, each of the two contacts carried by each of the ends being adapted to cooperate electrically with the contacts carried by the complementary ends of the adjacent elements.

9. The assembly as claimed in claim 8, wherein one or other of said second ends of said double connectors includes a scraper for wiping and sealing the electric contact between said two ends.

10. The assembly as claimed in claims 1 to 9, wherein one at least of said second ends of one of said double connectors is made from an elastomer having a reinforcement element.

11. The assembly as claimed in one of claims 1 to 10, wherein one at least of the ends of said pipe includes a cavity internal to said pipe and external to the second end of a double connector and includes a hydraulic connection said hydraulic connection connecting said cavity to the inside of the double connector, said connection being adapted to provide the balancing of said connection between two adjacent pipe elements.

12. The assembly as claimed in one of claims 1 to 11, wherein the connection of the second end of said first double connector with the second end of said second double connector of the adjacent pipe element contacting defines two surfaces and said surfaces are made from wear resistant materials.

13. The assembly as claimed in one of claims 1 to 12, wherein said conductor is held in position inside said pipe element by a support.

* * * * *